US006553579B1

(12) United States Patent
Gillen et al.

(10) Patent No.: US 6,553,579 B1
(45) Date of Patent: Apr. 29, 2003

(54) PROTECTIVE SHOULDER PAD

(76) Inventors: James B. Gillen, 444 W. Witchwood, Lake Bluff, IL (US) 60044; Sherry S. Gillen, 444 W. Witchwood, Lake Bluff, IL (US) 60044

( * ) Notice: Subject to any disclaimer, the term of this patent is extended or adjusted under 35 U.S.C. 154(b) by 0 days.

(21) Appl. No.: 10/236,232

(22) Filed: Sep. 6, 2002

Related U.S. Application Data

(63) Continuation-in-part of application No. 10/118,676, filed on Apr. 9, 2002, which is a continuation-in-part of application No. 10/000,246, filed on Oct. 29, 2001, now Pat. No. 6,446,273.

(51) Int. Cl.[7] ..... A41D 13/00
(52) U.S. Cl. ..... 2/268; 2/459
(58) Field of Search ..... 2/267, 268, 455, 2/459, 44, 45, 310, 326–328, 460–461; 224/259, 264–265, 201; 602/61–63, 4–5, 19–20

(56) References Cited

U.S. PATENT DOCUMENTS 4,168,544 A * 9/1979 Kallman ..... 2/94
4,322,859 A * 4/1982 Mitchell ..... 2/462
4,353,133 A * 10/1982 Williams ..... 2/459
5,319,806 A * 6/1994 Hermann et al. ..... 2/461

* cited by examiner

*Primary Examiner*—Gloria M. Hale
*Assistant Examiner*—Tejash Patel
(74) *Attorney, Agent, or Firm*—Meroni & Meroni, P.C.; Christopher J. Scott

(57) ABSTRACT

This invention concerns a removable protective shoulder pad for protecting against impact to the top, anterior, posterior or lateral regions of the shoulder and upper arm, or portions thereof, during sporting activities comprising one or more sections that can be secured to a protective body vest a shirt, a vest or other garment. The removable protective pad, comprising an outer layer or layers of rigid, semi-rigid or semi-flexible material and an inner layer or layers of flexible, semi-flexible or semi-rigid material, is secured to the shoulder portion or upper arm portion of the protective body vest, the shirt, the vest or other garment by a fastening device or devices. The removable protective pad may further be secured to the upper arm and/or shoulder by a fastening device or devices.

9 Claims, 4 Drawing Sheets

PROTECTIVE SHOULDER PAD

PRIOR HISTORY

This is a Continuation-in-Part Application of U.S. patent application Ser. No. 10/118,676, filed Apr. 9, 2002, which application is a Continuation-in-Part Application of U.S. patent application Ser. No. 10/000,246, filed Oct. 29, 2001, now U.S. Pat. No. 6,446,273.

BACKGROUND OF THE INVENTION

1. Field of the Invention

The present invention generally relates to a removable protective shoulder pad. More particularly, the present invention relates to a removable protective pad for use in combination with a protective body vest or other similar garment to protect wearers from injury to the top, anterior, posterior or lateral regions of the shoulder and upper arm, or portions thereof, during sporting activities.

2. Description of the Prior Art

Typically, inline skaters and skateboarders wear protective pads on their elbows and knees, a helmet and wrist guards. Although impact to the shoulder and upper arm areas occasionally occurs as a result of an inline skating or skateboarding accident, particularly in falls at inline skating/skateboarding parks due to the extreme surface inclines, protective padding is usually not worn in the shoulder or upper arm area. The disinclination by skaters to wear protective padding in the shoulder or upper arm area is likely attributable in part to a general impression in the skating community that any currently available protective padding, whether or not it is designed specifically for skaters, does not adequately address the comfort, safety, athletic performance and ease of-use issues of the skater.

It is therefore highly advantageous to provide a protective pad that can be easily attached to and removed from a protective body vest, such as those described in U.S. patent application Ser. Nos. 10/000,246 and 10/118,676, or other shirt, vest, or similar garment. Further, it is highly advantageous to provide a protective pad that is relatively unobtrusive to the wearer, allows unhindered movement of the shoulders and arms of the wearer and protects the top, anterior, posterior and lateral regions of the shoulder and upper arm.

SUMMARY OF INVENTION

According to our present invention, we have provided a single-section removable protective pad that can be secured to a protective body vest, such as those described in U.S. patent application Ser. Nos. 10/000,246 and 10/118,676, or other shirt, vest or similar garment for the purpose of protecting against impact to the top, anterior, posterior or lateral regions of the shoulder and upper arm, or portions thereof. The single-section removable protective pad generally comprises a layer or layers of a protective padding material or materials. The outer layer or layers of the single-section removable protective pad, or a portion or portions thereof, comprises rigid, semi-rigid or semi-flexible material for the purpose of protecting the underlying shoulder and upper arm from impact. The inner layer or layers of the single-section removable protective pad, or a portion or portions thereof, comprises flexible, semi-flexible or semi-rigid material for the purpose of protecting the underlying shoulder and upper arm from impact.

The single-section removable protective pad comprises a single- or multi-part strap or straps attached to the single-section removable protective pad by fastening means and/or a fastening device or devices that wrap around the shoulder portion or shoulder/upper arm portion of the protective body vest, such as those described in U.S. patent application Ser. Nos. 10/000,246 and 10/118,676, a shirt, a vest or other garment. The single-part strap or straps are fastened onto itself and/or onto the single-section removable protective pad and the multi-part strap or straps are fastened together and/or onto the single-section removable protective pad by a fastening device or devices to secure the single-section removable protective pad to the shoulder portion or upper arm portion of the protective body vest, such as those described in U.S. patent application Ser. Nos. 10/000,246 and 10/118,676, a shirt, a vest or other garment. The single- or multi-part strap or straps is/are adjustable. The single- or multi-part strap or straps may pass through a loop or loops on and/or an opening or openings in and/or a slot or slots in the single-section removable protective pad. The single- or multi-part strap or straps may comprise elastic material. The single- or multi-part strap or straps may be removable.

The single-section removable protective pad may further comprise a fastening device or devices attached on the single-section removable protective pad by fastening means and/or a fastening device or devices to secure the single-section removable protective pad onto a user's arm and/or onto a user's shoulder area.

The fastening device or devices securing the single-section removable protective pad onto a user's arm and/or onto a user's shoulder area may comprise a single- or a multi-part strap or straps attached to the single-section removable protective pad by fastening means and/or a fastening device or devices, the single- or multi-part strap or straps encircling the upper arm and/or shoulder area, the single-part strap or straps being fastened onto itself and/or onto the single-section removable protective pad and the parts of the multi-part strap or straps being fastened together and/or onto the single-section removable protective pad by a fastening device or devices to secure the single-section removable protective pad to the upper arm and/or shoulder area. The single- or multi-part securing strap or straps may be adjustable. The single- or multi-part securing strap or straps may be removable. The single- or multi-part securing strap or straps may be constructed of or comprise elastic material. The single- or multi-part securing strap or straps may pass through a slot or slots in and/or an opening or openings in and/or a loop or loops on the single-section removable protective pad.

The single-section removable protective pad may be secured onto the shoulder portion and/or onto the upper arm portion of the protective body vest, the shirt, the vest or other garment by a fastening device or devices attached by fastening means and/or a fastening device or devices on the single-section removable protective pad and/or on the single- or multi-part strap or straps attached on the single-section removable protective pad and/or on any part or parts and/or component or components of the single-section removable protective pad, including any attachments, and correspondingly on the shoulder portion and/or on the upper arm portion of the protective body vest, the shirt, the vest or other garment.

The fastening device or devices securing the single-section removable protective pad onto the shoulder portion and/or onto the upper arm portion of the protective body vest, the shirt, the vest or other garment may comprise a strap or straps and/or a pad or pads attached on the single-section removable protective pad by a fastening means and/or a fastening device or devices, the strap or straps and/or the pad or pads being fastened onto the shoulder portion and/or the upper arm portion of the protective body vest, the shirt, the vest or other garment by a fastening device or devices attached onto the strap or straps and/or the pad or pads and correspondingly on the shoulder portion and/or the upper arm portion of the protective body vest, the shirt, the vest or other garment. The strap or straps and/or the pad or pads may be adjustable. The strap or straps and/or the pad or pads may pass through a slot or slots in and/or an opening or openings in and/or a loop or loops on the single-section removable protective pad. The strap or straps and/or the pad or pads may be removable.

The single-section removable protective pad may further be punctuated with air holes.

In another embodiment, we have provided a multi-section removable protective pad that can be secured to a protective body vest, such as those described in U.S. patent application Ser. Nos. 10/000,246 and 10/118,676, or other shirt, vest or similar garment for the purpose of protecting against impact to the top, anterior, posterior or lateral regions of the shoulder and upper arm, or portions thereof. The multi-section removable protective pad generally comprises a layer or layers of a protective padding material or materials. The outer layer or layers of the multi-section removable protective pad, or a portion or portions thereof, comprises rigid, semi-rigid or semi-flexible material for the purpose of protecting the underlying shoulder and upper arm from impact. The inner layer or layers of the multi-section removable protective pad, or a portion or portions thereof, comprises flexible, semi-flexible or semi-rigid material for the purpose of protecting the underlying shoulder and upper arm from impact.

The multi-section removable protective pad comprises a single- or multi-part strap or straps attached to the multi-section removable protective pad, or a section or sections thereof, by a fastening means and/or a fastening device or devices that wraps around the shoulder portion or shoulder/upper arm portion of the protective body vest, such as those described in U.S. patent application Ser. Nos. 10/000,246 and 10/118,676, a shirt, a vest or other garment. The single-part strap or straps are fastened onto itself and/or onto the multi-section removable protective pad, or a section or sections thereof, and the parts of the multi-part strap or straps are fastened together and/or onto the multi-section removable protective pad, or a section or sections thereof, by a fastening device or devices to secure the multi-section removable protective pad to the shoulder portion or upper arm portion of the protective body vest, such as those described in U.S. patent application Ser. Nos. 10/000,246 and 10/118,676, a shirt, a vest or other garment. The single- or multi-part strap or straps are further adjustable. The single- or multi-part strap or straps may pass through a loop or loops on and/or an opening or openings in and/or a slot or slots in the multi-section removable protective pad, or a section or sections thereof. The single- or multi-part strap or straps may comprise elastic material. The single- or multi-part strap or straps may be removable.

The sections of the multi-section removable protective pad are fastened together by a fastening device or devices.

The multi-section removable protective pad may comprise a fastening device or devices attached on the multi-section removable protective pad, or a section or sections thereof, by a fastening means and/or a fastening device or devices to secure the multi-section removable protective pad onto a user's arm and/or onto a user's shoulder area.

The fastening device or devices securing the multi-section removable protective pad onto a user's arm and/or onto a user's shoulder area may comprise a single- or a multi-part strap or straps attached to the multi-section removable protective pad, or a section or sections thereof, by a fastening means and/or a fastening device or devices, the single- or multi-part strap or straps encircling the upper arm and/or shoulder area, the single-part strap or straps being fastened onto itself and/or onto the multi-section removable protective pad, or a section or sections thereof, and the parts of the multi-part strap or straps being fastened together and/or onto the multi-section removable protective pad, or a section or sections thereof, by a fastening device or devices to secure the multi-section removable protective pad to the upper arm and/or shoulder area. The single- or multi-part securing strap or straps is/are adjustable. The single- or multi-part securing strap or straps may pass through a slot or slots in and/or an opening or openings in and/or a loop or loops on the multi-section removable protective pad, or a section or sections thereof. The single- or multi-part securing strap or straps may be constructed of or comprise elastic material. The single- or multi-part securing strap or straps may be removable.

The multi-section removable protective pad may be secured onto the shoulder portion and/or onto the upper arm portion of the protective body vest, the shirt, the vest or other garment by a fastening device or devices attached by a fastening means and/or a fastening device or devices on the multi-section removable protective pad, or a section or sections thereof, and/or on the single- or multi-part strap or straps attached on the multi-section removable protective pad, or a section or sections thereof, and/or on any part or parts and/or component or components of the multi-section removable protective pad, including any attachments, and correspondingly on the shoulder portion and/or on the upper arm portion of the protective body vest, the shirt, the vest or other garment.

The fastening device or devices securing the multi-section removable protective pad onto the shoulder portion and/or onto the upper arm portion of the protective body vest, the shirt, the vest or other garment may comprise a strap or straps and/or a pad or pads attached on the multi-section removable protective pad, or a section or sections thereof, by a fastening means and/or a fastening device or devices, the strap or straps and/or the pad or pads being fastened onto the shoulder portion and/or the upper arm portion of the protective body vest, the shirt, the vest or other garment by a fastening device or devices attached onto the strap or straps and/or the pad or pads and correspondingly on the shoulder portion and/or the upper arm portion of the protective body vest, the shirt, the vest or other garment. The strap or straps and/or the pad or pads may be adjustable. The strap or straps may pass through a slot or slots in and/or an opening or openings in and/or a loop or loops on the single-section removable protective pad. The strap or straps and/or the pad or pads may be removable. The multi-section removable protective pad, or a section or sections, or a portion or portions, or a layer or layers thereof, may be punctuated with air holes.

The sections of the multi-section removable protective pad, or a section or sections thereof, may be contoured to overlap with both each other and commercially available elbow pads similar in design to those utilized by skateboarders and inline skaters to provide continuous protection to the upper arm and shoulder regions.

The fastening device or devices fastening the sections of the multi-section removable protective pad together may comprise a strap or straps, the strap or straps being attached to a section or sections of the multi-section removable protective pad by a fastening means and/or a fastening device or devices, the strap or straps being fastened by a fastening device or devices to secure the sections of the multi-section removable protective pad together. The strap or straps fastening the sections of the multi-section removable protective pad together may be adjustable. The strap or straps fastening the sections of the multi-section removable protective pad together may be removable. The strap or straps fastening the sections of the multi-section removable protective pad together may be constructed from or comprise elastic material. The strap or straps fastening the sections of the multi-section removable protective pad together may pass through a slot or slots in and/or an opening or openings in and/or a loop or loops on a section or sections of the multi-section removable protective pad.

In another embodiment, we have provided a single-section removable protective pad that can be secured to a protective body vest, such as those described in U.S. patent application Ser. Nos. 10/000,246 and 10/118,676, or other shirt, vest or similar garment for the purpose of protecting against impact to the top, anterior, posterior or lateral regions of the shoulder and upper arm, or portions thereof. The single-section removable protective pad generally comprises a layer or layers of a protective padding material or materials. The outer layer or layers of the single-section removable protective pad, or a portion or portions thereof, comprises rigid, semi-rigid or semi-flexible material for the purpose of protecting the underlying shoulder and upper arm from impact. The inner layer or layers of the single-section removable protective pad, or a portion or portions thereof, comprises flexible, semi-flexible or semi-rigid material for the purpose of protecting the underlying shoulder and upper arm from impact.

The single-section removable protective pad being secured onto the shoulder portion and/or onto the upper arm portion of the protective body vest, the shirt, the vest or other garment by a fastening device or devices attached by a fastening means and/or a fastening device or devices on the single-section removable protective pad and/or on any part or parts and/or component or components of the single-section removable protective pad, including any attachments, and correspondingly on the shoulder portion and/or on the upper arm portion of the protective body vest, the shirt, the vest or other garment.

The single-section removable protective pad further comprises a fastening device or devices attached on the single-section removable protective pad by a fastening means and/or a fastening device or devices to secure the single-section removable protective pad onto a user's arm and/or onto a user's shoulder area, the fastening device or devices securing the single-section removable protective pad onto a user's arm and/or onto a user's shoulder area being removable.

The fastening device or devices securing the single-section removable protective pad onto the shoulder portion and/or onto the upper arm portion of the protective body vest, the shirt, the vest or other garment may comprise a strap or straps and/or a pad or pads attached on the single-section removable protective pad by a fastening means and/or a fastening device or devices, the strap or straps and/or the pad or pads being fastened onto the shoulder portion and/or the upper arm portion of the protective body vest, the shirt, the vest or other garment by a fastening device or devices attached onto the strap or straps and/or the pad or pads and correspondingly on the shoulder portion and/or the upper arm portion of the protective body vest, the shirt, the vest or other garment. The strap or straps and/or the pad or pads may be adjustable. The strap or straps and/or the pad or pads may pass through a slot or slots in and/or an opening or openings in and/or a loop or loops on the single-section removable protective pad. The strap or straps and/or the pad or pads may be removable.

The fastening device or devices securing the single-section removable protective pad onto a user's arm and/or onto a user's shoulder area may comprise a single- or a multi-part strap or straps attached to the single-section removable protective pad by a fastening means and/or a fastening device or devices, the single- or multi-part strap or straps encircling the upper arm and/or shoulder area, the single-part strap or straps being fastened onto itself and/or onto the single-section removable protective pad and the parts of the multi-part strap or straps being fastened together and/or onto the single-section removable protective pad by a fastening device or devices to secure the single-section removable protective pad to the upper arm and/or shoulder area. The single- or multipart securing strap or straps may be adjustable. The single- or multi-part securing strap or straps may further be constructed of or comprise elastic material. The single- or multi-part securing strap or straps may further pass through a slot or slots in and/or an opening or openings in and/or a loop or loops on the single-section removable protective pad.

The single-section removable protective pad may further be punctuated with air holes.

In another embodiment, we have provided a multi-section removable protective pad that can be secured to a protective body vest, such as those described in U.S. patent application Ser. Nos. 10/000,246 and 10/118,676, or other shirt, vest or similar garment for the purpose of protecting against impact to the top, anterior, posterior or lateral regions of the shoulder and upper arm, or portions thereof. The multi-section removable protective pad generally comprises a layer or layers of a protective padding material or materials. The outer layer or layers of the multi-section removable protective pad, or a portion or portions thereof, comprises rigid, semi-rigid or semi-flexible material for the purpose of protecting the underlying shoulder and upper arm from impact. The inner layer or layers of the multi-section removable protective pad, or a portion or portions thereof, comprises flexible, semi-flexible or semi-rigid material for the purpose of protecting the underlying shoulder and upper arm from impact.

The multi-section removable protective pad, or a section or sections thereof, being secured onto the shoulder portion and/or onto the upper arm portion of the protective body vest, the shirt, the vest or other garment by a fastening device or devices attached by fastening means and/or a fastening device or devices on the multi-section removable protective pad, or a section or sections thereof, and/or on any part or parts and/or component or components of the multi-section removable protective pad, including any attachments, and correspondingly on the shoulder portion and/or on the upper arm portion of the protective body vest, the shirt, the vest or other garment.

The multi-section removable protective pad is secured onto a user's arm and/or onto a user's shoulder area by a fastening device or devices attached on the multi-section removable protective pad, or a section or sections thereof, by fastening means and/or a fastening device or, the fastening device or devices securing the multi-section removable protective pad onto a user's arm and/or onto a user's shoulder area being removable.

The fastening device or devices securing the multi-section removable protective pad onto the shoulder portion and/or onto the upper arm portion of the protective body vest, the shirt, the vest or other garment may comprise a strap or straps and/or a pad or pads attached on the multi-section removable protective pad, or a section or sections thereof, by fastening means and/or a fastening device or devices, the strap or straps and/or the pad or pads being fastened onto the shoulder portion and/or the upper arm portion of the protective body vest, the shirt, the vest or other garment by a fastening device or devices attached onto the strap or straps and/or the pad or pads and correspondingly on the shoulder portion and/or the upper arm portion of the protective body vest, the shirt, the vest or other garment. The strap or straps and/or the pad or pads may be adjustable. The strap or straps may pass through a slot or slots in and/or an opening or openings in and/or a loop or loops on the single-section removable protective pad. The strap or straps and/or the pad or pads may be removable.

The fastening device or devices securing the multi-section removable protective pad onto a user's arm and/or onto a user's shoulder area may comprise a single- or a multi-part strap or straps attached to the multi-section removable protective pad, or a section or sections thereof, by fastening means and/or a fastening device or devices, the single- or multi-part strap or straps encircling the upper arm and/or shoulder area, the single-part strap or straps being fastened onto itself and/or onto the multi-section removable protective pad, or a section or sections thereof, and the parts of the multi-part strap or straps being fastened together and/or onto the multi-section removable protective pad, or a section or sections thereof, by a fastening device or devices to secure the multi-section removable protective pad to the upper arm and/or shoulder area. The single- or multi-part securing strap or straps is/are adjustable. The single- or multi-part securing strap or straps may pass through a slot or slots in and/or an opening or openings in and/or a loop or loops on the multi-section removable protective pad, or a section or sections thereof. The single- or multi-part securing strap or straps may be constructed of or comprise elastic material.

The multi-section removable protective pad, or a section or sections, or a portion or portions, or a layer or layers thereof, may be punctuated with air holes.

The sections of the multi-section removable protective pad, or a section or sections thereof, may be contoured to overlap with both each other and commercially available elbow pads similar in design to those utilized by skateboarders and inline skaters to provide continuous protection to the upper arm and shoulder regions.

The sections of the multi-section removable protective pad are fastened together by a fastening device or devices.

The fastening device or devices fastening the sections of the multi-section removable protective pad together may comprise a strap or straps, the strap or straps being attached to a section or sections of the multi-section removable protective pad by fastening means and/or a fastening device or devices, the strap or straps being fastened by a fastening device or devices to secure the sections of the multi-section removable protective pad together. The strap or straps fastening the sections of the multi-section removable protective pad together may be adjustable. The strap or straps fastening the sections of the multi-section removable protective pad together may be removable. The strap or straps fastening the sections of the multi-section removable protective pad together may be constructed from or comprise elastic material. The strap or straps fastening the sections of the multi-section removable protective pad together may pass through a slot or slots in and/or an opening or openings in and/or a loop or loops on a section or sections of the multi-section removable protective pad.

Other objects of our invention, as well as particular features, elements, and advantages thereof, will be elucidated in, or apparent from, the following description and the accompanying drawing figures.

DESCRIPTION OF THE DRAWINGS

Other features of our invention will become more evident from a consideration of the detailed description of our patent drawings, as follows.

DETAILED DESCRIPTION

Figure 1:
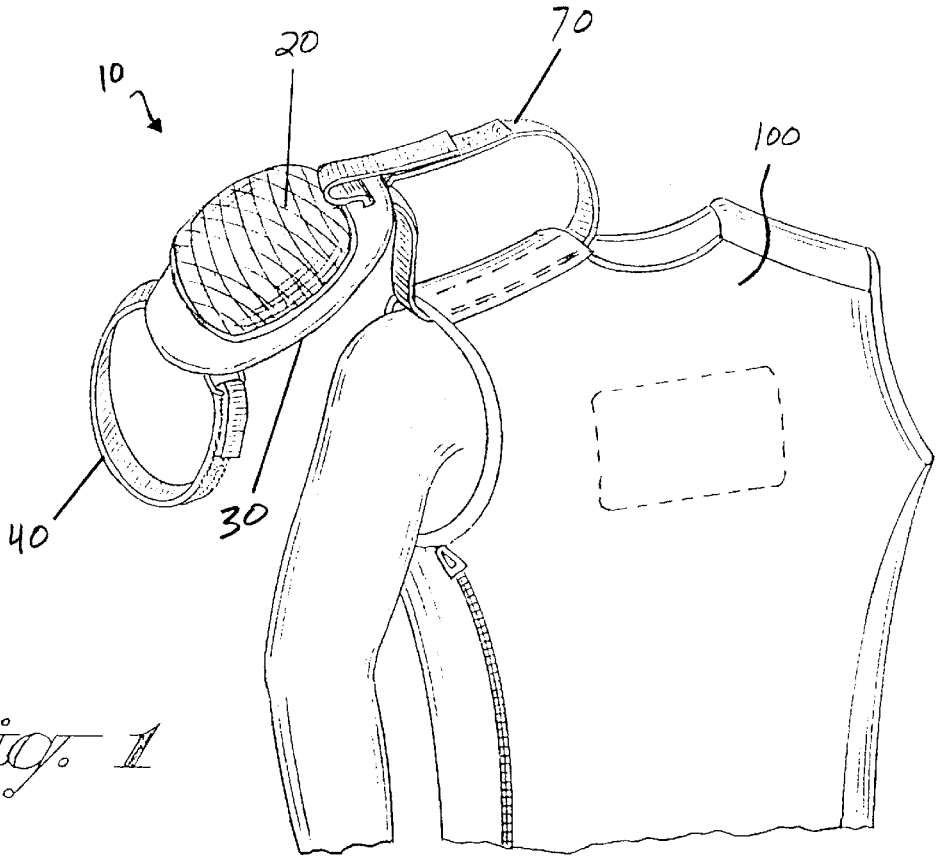
FIG. 1 is a perspective view of a single-section removable protective pad approaching the upper arm/shoulder area and the protective body vest.
Figure 2:
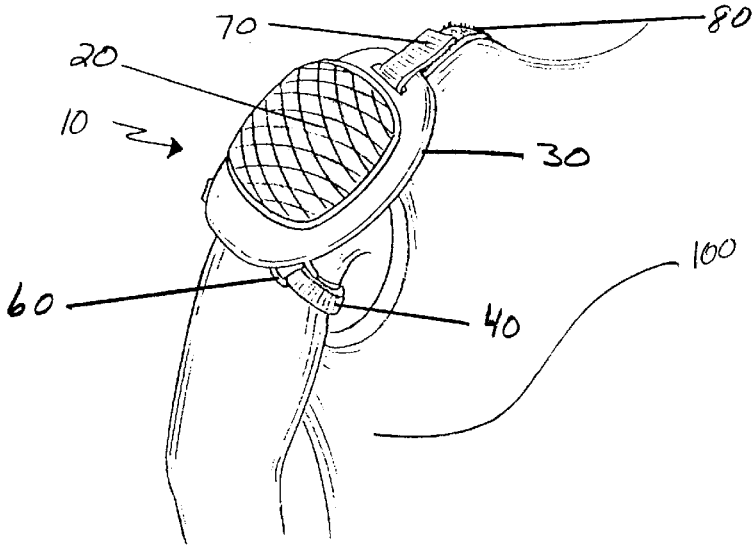
FIG. 2 is a perspective view of a single-section removable protective pad secured onto the upper arm and a protective body vest.

Referring now to the drawings, the preferred embodiment of the present invention is generally illustrated in FIGS. 1, 2, 3, and 4 and essentially comprises a removable protective pad and article of clothing combination, or a removable protective pad for use in combination with an article of clothing, the removable protective pad having a shoulder attachment section or sections. As illustrated in FIGS. 1 and 2, the preferred embodiment of the present invention comprises a single-section removable protective pad 10 that can be secured to a protective body vest 100 such as the protective body vests as described in U.S. patent application Ser. Nos. 10/000,246 and 10/118,676. The reader is directed to the specifications of U.S. patent applications Ser. Nos. 10/000,246 and 10/118,676, which are hereby incorporated by reference thereto. Removable protective pad 10 is designed for the purpose of protecting against impact to the top, anterior, posterior or lateral regions of the shoulder and upper arm, or portions thereof. Furthermore, the preferred embodiment of the present invention comprises a single-section removable protective pad 10 that can be also secured to a shirt, a vest or other garment for the purpose of protecting against impact to the top, anterior, posterior or lateral regions of the shoulder and upper arm, or portions thereof.

The single-section removable protective pad 10 comprises or is constructed of a layer or layers of a protective padding material or materials. As generally illustrated in FIGS. 1–6, inclusive, the outer layer or layers 20 of the single-section removable protective pad, or a portion or portions thereof, comprises or is constructed of rigid, semi-rigid or semi-flexible material for the purpose of protecting the underlying shoulder and upper arm from impact. As illustrated in FIGS. 1–6, inclusive, the inner layer or layers 30 of the single-section removable protective pad, or a portion or portions thereof, comprises or is constructed of flexible, semi-flexible or semi-rigid material for the purpose of protecting the underlying shoulder and upper arm from impact.

As specifically illustrated in FIGS. 1 and 2, the single-section removable protective pad 10 is secured to a protective body vest 100 such as those described in U.S. patent application Ser. Nos. 10/000,246 and 10/118,676 by an adjustable, elastic strap 70. As further generally illustrated in FIGS. 1–6, the single-section removable protective pad 10 is secured to a protective body vest, a shirt, a vest or other garment by an adjustable, elastic strap 70 such that adjustable, elastic strap 70 wraps around the shoulder portion or upper arm portion of the protective body vests as described in U.S. patent application Ser. Nos. 10/000,246 and 10/118,676, a shirt, a vest or other garment. As generally illustrated in FIGS. 1–6, inclusive and as specifically illustrated in FIGS. 3 and 5, adjustable, elastic strap 70 comes back through a slot or opening 90 in the single-section removable protective pad 10—although a loop attached onto the single-section removable protective pad could be utilized, in which case the attached end of the strap would probably be attached to the singe-section removable protective pad 10 by being fastened onto the same loop—and is fastened onto itself by a fastening device 80 (as referenced in FIGS. 2 and 3) to secure the single-section removable protective pad 10 to the shoulder portion or upper arm portion of the protective body vests such as those described in U.S. patent application Ser. Nos. 10/000,246 and 10/118,676, a shirt, a vest or other garment. Excellent results are obtained when the fastening device 80 comprises or is constructed of hook-and-loop fastening-type material. An optional feature of this version of the single-section removable protective pad 10 not depicted enables the adjustable, elastic strap 70 to be additionally secured by directly fastening to, in addition to wrapping around, the shoulder portion or upper arm portion of the protective body vests such as those described in U.S. patent application Ser. Nos. 10/000,246 and 10/118,676, a shirt, a vest or other garment by a fastening device or devices attached to the adjustable, elastic strap 70 and correspondingly on the shoulder portion or upper arm portion of the protective body vests such as those described in U.S. patent application Ser. Nos. 10/000,246 and 10/118,676, a shirt, a vest or other garment. Excellent results are obtained when the fastening device comprises or is constructed of hook-and-loop fastening-type material. With this optional feature the adjustable, elastic strap 70 is first directly fastened to, and then wrapped around the shoulder portion or upper arm portion of the protective body vests such as those described in U.S. patent application Ser. Nos. 10/000,246 and 10/118,676, a shirt, a vest or other garment before coming back through a slot or opening in or a loop on the single-section removable protective pad 10 and being fastened onto itself.

In an alternative version of the single-section removable protective pad not depicted, both ends of the strap securing the single-section removable protective pad to the protective body vests such as those described in U.S. patent application Ser. Nos. 10/000,246 and 10/118,676, a shirt, a vest or other garment run through slots or openings in, or loops on, the single-section removable protective pad, reverse back, and fasten onto itself, thereby making the strap removable. As with the preferred embodiment of the present invention, an optional feature of this version of the single-section removable protective pad 10 not depicted enables the adjustable, elastic strap 70 to be additionally secured by directly fastening to, in addition to wrapping around, the shoulder portion or upper arm portion of the protective body vests such as those described in U.S. patent application Ser. Nos. 10/000,246 and 10/118,676, a shirt, a vest or other garment by a fastening device or devices attached to the adjustable, elastic strap 70 and correspondingly on the shoulder portion or upper arm portion of the protective body vests such as those described in U.S. patent application Ser. Nos. 10/000,246 and 10/118,676, a shirt, a vest or other garment. Excellent results are obtained when the fastening device comprises or is constructed of hook-and-loop fastening-type material.

In another alternative version of the single-section removable protective pad not depicted, the pad is fastened onto the shoulder/upper arm portion of the protective body vests such as those described in U.S. patent application Ser. Nos. 10/000,246 and 10/118,676, a shirt, a vest or other garment by a multi-part strap, the parts of which are fastened together to secure the single-section removable protective pad onto the shoulder/upper arm portion of the protective body vests such as those described in U.S. patent application Ser. Nos. 10/000,246 and 10/118,676, a shirt, a vest or other garment. An optional feature of this version of the single-section removable protective pad 10 not depicted enables a section of the adjustable, elastic, multi-part strap to be additionally secured by directly fastening to, in addition to wrapping around, the shoulder portion or upper arm portion of the protective body vests such as those described in U.S. patent application Ser. Nos. 10/000,246 and 10/118,676, a shirt, a vest or other garment by a fastening device or devices attached to the section of the adjustable, elastic, multi-part strap and correspondingly on the shoulder portion or upper arm portion of the protective body vests such as those described in U.S. patent application Ser. Nos. 10/000,246 and 10/118,676, a shirt, a vest or other garment. Excellent results are obtained when the fastening device comprises or is constructed of hook-and-loop fastening-type material. With this optional feature a section of the adjustable, elastic, multi-part strap 70 would first be directly fastened to, and then wrapped around the shoulder portion or upper arm portion of the protective body vests such as those described in U.S. patent application Ser. Nos. 10/000,246 and 10/118,676, a shirt, a vest or other garment before being fastened to the other part of the multi-part strap.

In yet another alternative version of the single-section removable protective pad not depicted, the pad is fastened onto the shoulder and/or upper arm portion of the protective body vests such as those described in U.S. patent application Ser. Nos. 10/000,246 and 10/118,676, a shirt, a vest or other garment by a fastening device such as a snap fastener, button fastener, hook-and-loop fastening-type material, a partial strap with a snap fastener, button fastener or hook-and-loop fastening-type material or a pad with a snap fastener, button fastener or hook-and-loop fastening-type material attached to the single-section removable protective pad and correspondingly on the shoulder and/or upper arm portion of the protective body vests such as those described in U.S. patent application Ser. Nos. 10/000,246 and 10/118,676, a shirt, a vest or other garment, whereby the partial strap and pad essentially serve to bridge the distance between the single-section removable protective pad and the shoulder or upper arm portion of the protective body vests such as those described in U.S. patent application Ser. Nos. 10/000,246 and 10/118,676, a shirt, a vest or other garment, the pad being similar in function to the shoulder pads commonly utilized in select women's clothing by building up and/or reinforcing the shoulder area or a portion thereof.

In still yet another alternative version of the single-section removable protective pad not depicted, the pad is fastened onto the shoulder and/or upper arm portion of the protective body vests such as those described in U.S. patent application Ser. Nos. 10/000,246 and 10/118,676, a shirt, a vest or other garment by an adjustable, elastic strap that wraps around the shoulder portion and/or upper arm portion of the protective body vests such as those described in U.S. patent application Ser. Nos. 10/000,246 and 10/118,676, a shirt, a vest or other garment by first being routed under the shoulder and/or upper arm portion of the protective body vests such as those described in U.S. patent application Ser. Nos. 10/000,246 and 10/118,676, a shirt, a vest or other garment, being reversed back over the shoulder portion and/or upper arm portion and routing through a loop attached onto the single-section removable protective pad before being fastened onto itself. If the end of the adjustable, elastic strap which is attached to the single-section removable protective pad is attached by being routed through another loop attached to the single-section removable protective pad, reversing back and being attached to itself, then, regardless of whether or not the strap itself is removable from the pad, this version of the single-section removable protective pad would thus allow the strap to be wrapped around the shoulder and/or upper arm portion of the protective body vests such as those described in U.S. patent application Ser. Nos. 10/000,246 and 10/118,676, a shirt, a vest or other garment in either direction. If the strap is first routed under the shoulder and/or upper arm portion of the protective body vests such as those described in U.S. patent application Ser. Nos. 10/000,246 and 10/118,676, a shirt, a vest or other garment, the strap would then be routed through the other loop, the other loop being attached to the single-section removable protective pad on top of the loop which is used to attach the strap to the pad. If the strap is first routed over the shoulder and/or upper arm portion of the protective body vests such as those described in U.S. patent application Ser. Nos. 10/000,246 and 10/118,676, a shirt, a vest or other garment, the strap would then be routed through the same loop used to attach the strap to the single-section removable protective pad before reversing back and being fastened to itself. Although in this case the other loop would probably go unused, the strap could actually be routed through both loops before reversing back and fastening to itself.

Figure 3:
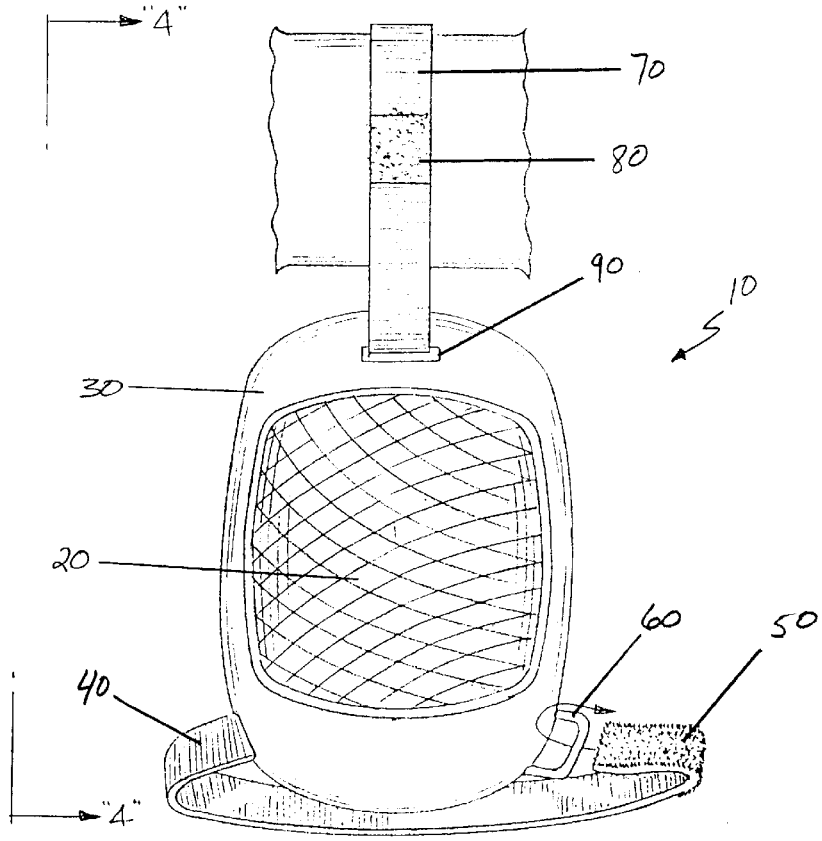
FIG. 3 is a top view of a single-section removable protective pad.
Figure 4:
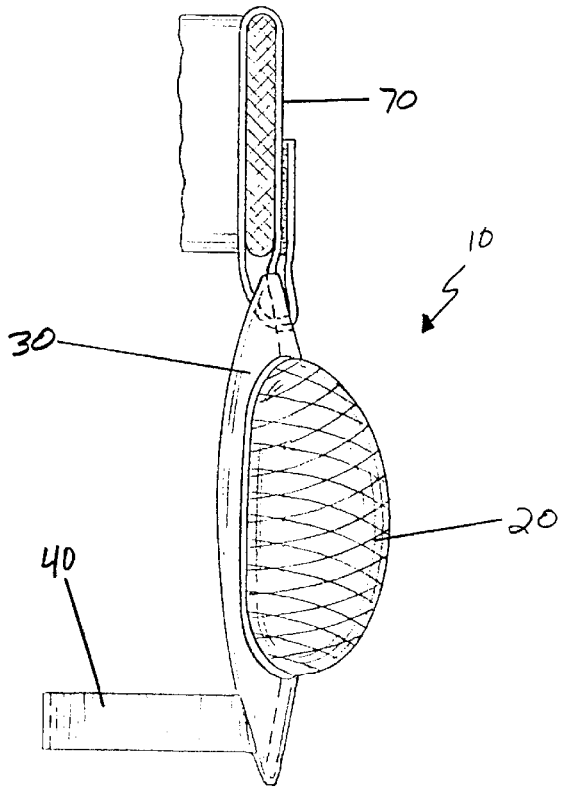
FIG. 4 is a side view of a single-section removable protective pad.
Figure 5:
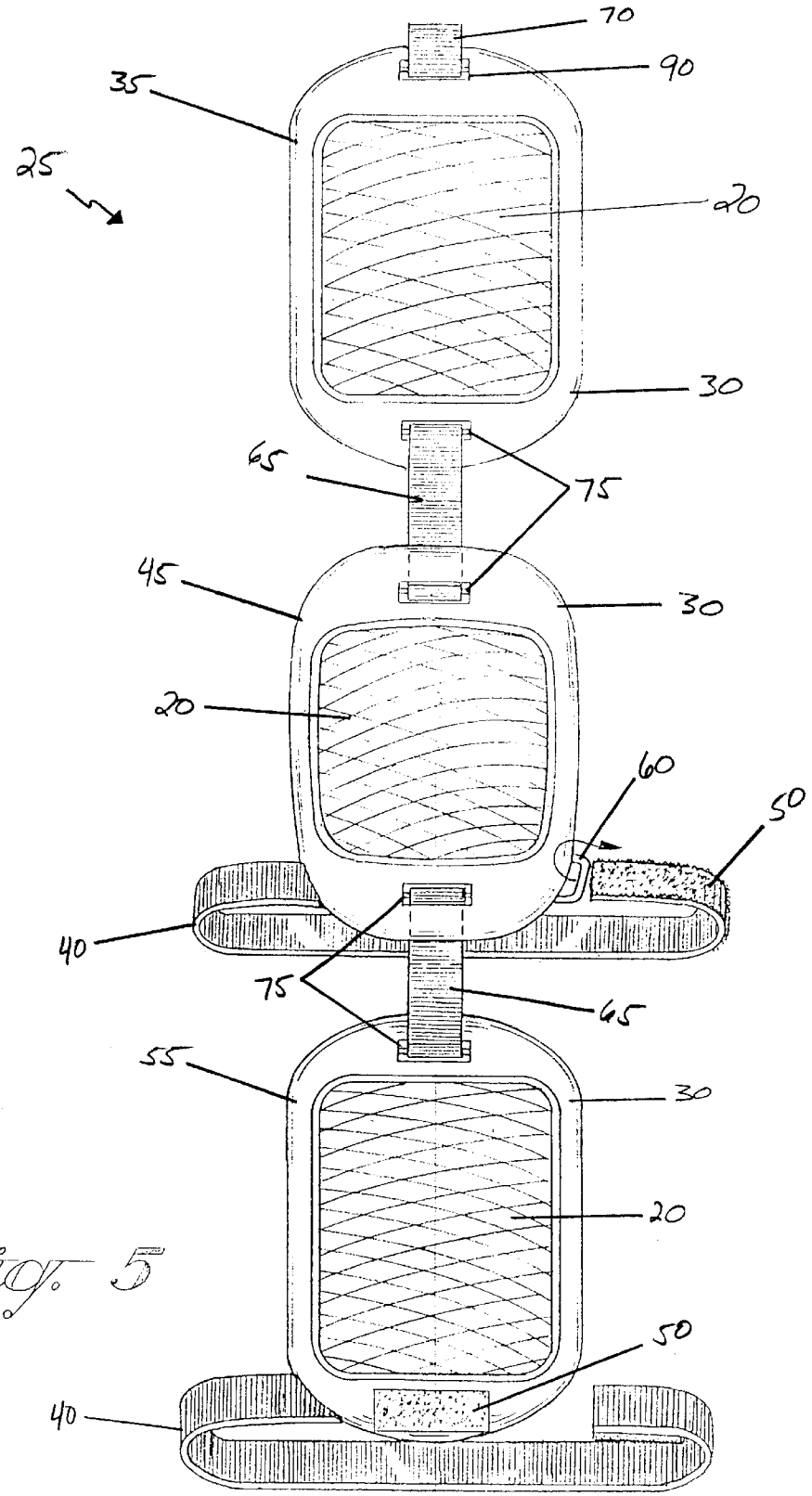
FIG. 5 is a top view of a multi-section removable protective pad.

As illustrated in FIGS. 1–6, the single-section removable protective pad 10 is secured to the upper arm and/or shoulder by an adjustable, elastic strap 40 that encircles the upper arm and/or shoulder and is inserted through a loop 60 (as referenced in FIGS. 2, 3, and 5) attached to the single-section removable protective pad 10—although a slot or opening in the single-section removable protective pad could be utilized—reverses back, and is fastened onto itself by a fastening device 50 to secure the single-section removable protective pad to the upper arm and/or shoulder, as specifically illustrated in FIGS. 3 and 5 and as generally shown in FIGS. 1, 2, 3 and 5. Excellent results are obtained when the fastening device 50 comprises or is constructed of hook-and-loop fastening-type material.

In an alternative version of the single-section removable protective pad not depicted, both ends of the strap securing the single-section removable protective pad to the upper arm and/or shoulder run through slots or openings in, or loops on, the single-section removable protective pad, reverse back, and fasten onto itself, thereby making the strap removable.

In another alternative version of the single-section removable protective pad not depicted, the pad is secured onto the upper arm and/or shoulder by a multi-part strap, the parts of which are fastened together to secure the single-section removable protective pad onto the upper arm and/or shoulder.

In yet another alternative version of the single-section removable protective pad not depicted, the single-section removable protective pad is secured onto 1) the upper arm by an adjustable, elastic strap that encircles the upper arm, is inserted through a loop attached to the single-section removable protective pad—although a slot or opening in the single-section removable protective pad could be utilized—reverses back, and is fastened onto itself by a fastening device to secure the single-section removable protective pad to the upper arm and 2) the shoulder by an adjustable, elastic strap that encircles the shoulder, is inserted through a loop attached to the single-section removable protective pad—although a slot or opening in the single-section removable protective pad could be utilized—reverses back, and is fastened onto itself by a fastening device to secure the single-section removable protective pad to the shoulder.

In still yet another alternative version of the single-section removable protective pad not depicted, the single-section removable protective pad is not secured to either the user's upper arm or shoulder by a fastening device or devices.

Figure 6:
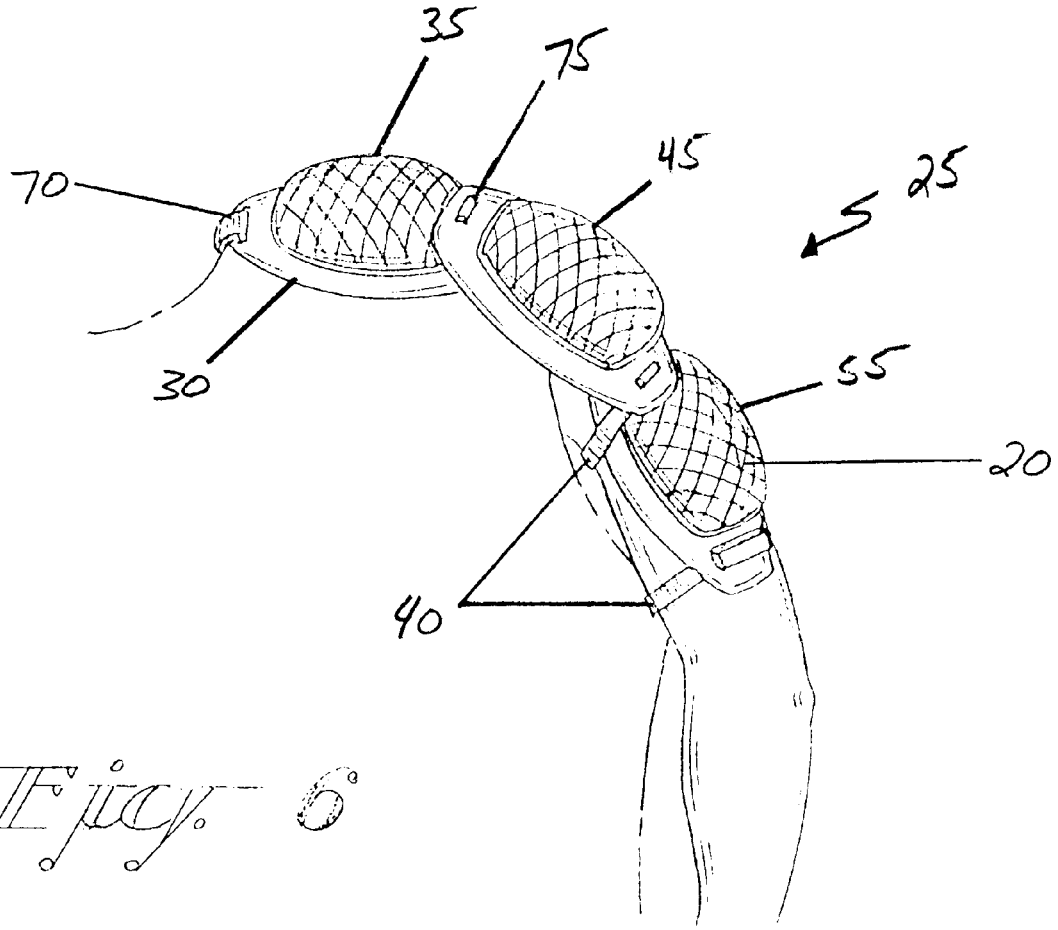
FIG. 6 is a perspective view of a multi-section removable protective pad secured onto the upper arm, shoulder and a protective body vest.

In another embodiment, as illustrated in FIGS. 5 and 6, the present invention comprises a multi-section removable protective pad 25 that can be secured to protective body vests such as those described in U.S. patent application Ser. Nos. 10/000,246 and 10/1 18,676, a shirt, a vest or other garment for the purpose of protecting against impact to the top, anterior, posterior or lateral regions of the shoulder and upper arm, or portions thereof, the multi-section removable protective pad 25 comprising a first section 35, a second section 45 and a third section 55, the sections being contoured to overlap with both each other and commercially available elbow pads similar in design to those utilized by skateboarders and inline skaters to provide continuous protection to the upper arm and shoulder regions.

The multi-section removable protective pad 25 comprises a layer or layers of a protective padding material or materials. The outer layer or layers 20 of the multi-section removable protective pad, or a portion or portions thereof, comprises or is constructed of rigid, semi-rigid or semi-flexible material for the purpose of protecting the underlying shoulder and upper arm from impact. The inner layer or layers 30 of the multi-section removable protective pad, or a portion or portions thereof, comprises or is constructed of flexible, semi-flexible or semi-rigid material for the purpose of protecting the underlying shoulder and upper arm from impact.

As illustrated in FIGS. 5 and 6, the multi-section removable protective pad 25 may be secured to protective body vests such as those described in U.S. patent application Ser. Nos. 10/000,246 and 10/118,676, a shirt, a vest or other garment by an adjustable, elastic strap 70 attached to the multi-section removable protective pad 25 that wraps around the shoulder portion or shoulder/upper arm portion of the protective body vests as described in U.S. patent application Ser. Nos. 10/000,246 and 10/118,676, a shirt, a vest or other garment, comes back through a slot or opening 90 in the multi-section removable protective pad 25—although a loop attached onto the multi-section removable protective pad could be utilized in which case the attached end of the strap would probably be attached to multi-section removable protective pad 25 by being fastened onto the same loop—and is fastened onto itself by a fastening device 80 to secure the multi-section removable protective pad 25 to the shoulder portion or upper arm portion of the protective body vests such as those described in U.S. patent application Ser. Nos. 10/000,246 and 10/118,676, a shirt, a vest or other garment. Excellent results are obtained when the fastening device 80 comprises or is constructed of hook-and-loop fastening-type material.

In an alternative version of the multi-section removable protective pad, both ends of the strap securing the multi-section removable protective pad to the protective body vests such as those described in U.S. patent application Ser. Nos. 10/000,246 and 10/118,676, a shirt, a vest or other garment run through slots or openings in, or loops on, the multi-section removable protective pad, reverse back, and fasten onto itself, thereby making the strap removable.

In another alternative version of the multi-section removable protective pad, the multi-section removable protective pad, or a section or sections thereof, is fastened onto the shoulder/upper arm portion of the protective body vests as described in U.S. patent application Ser. Nos. 10/000,246 and 10/118,676, a shirt, a vest or other garment by a multi-part strap, the parts of which are fastened together to secure the multi-section removable protective pad onto the shoulder/upper arm portion of the protective body vests such as those described in U.S. patent application Ser. Nos. 10/000,246 and 10/118,676, a shirt, a vest or other garment.

In yet another alternative version of the multi-section removable protective pad, the multi-section removable protective pad, or a section or sections thereof, is fastened onto the shoulder and/or upper arm portion of the protective body vests such as those described in U.S. patent application Ser. Nos. 10/000,246 and 10/118,676, a shirt, a vest or other garment by a fastening device, such as a snap fastener, button fastener, hook-and-loop fastening-type material, a partial strap with a snap fastener, button fastener or hook-and-loop fastening-type material or a pad with a snap fastener, button fastener or hook-and-loop fastening-type material attached to the multi-section removable protective pad and correspondingly on the shoulder and/or upper arm portion of protective body vests such as those described in U.S. patent application Ser. Nos. 10/000,246 and 10/118,676, a shirt, a vest or other garment.

The multi-section removable protective pad 25 is secured to the upper arm and/or shoulder by an adjustable, elastic strap or straps 40 that encircle the upper arm and/or shoulder and are either 1) inserted through a loop 60 attached to the multi-section removable protective pad 25—although a slot or opening in the multi-section removable protective pad could be utilized—reverses back, and is fastened onto itself by a fastening device 50 or 2) is attached to a fastening device 50 on the multi-section removable protective pad 25 to secure the multi-section removable protective pad to the upper arm and/or shoulder, as illustrated in FIGS. 5 and 6. Excellent results are obtained when the fastening device 50 comprises or is constructed of hook-and-loop fastening-type material.

In an alternative version of the multi-section removable protective pad, both ends of the strap securing the multi-section removable protective pad to the upper arm and/or shoulder run through slots or openings in, or loops on, the multi-section removable protective pad, reverse back, and fasten onto themselves, thereby making the strap removable.

In another alternative version of the multi-section removable protective pad, the pad is fastened onto the upper arm and/or shoulder by a multi-part strap, the parts of which are fastened together to secure the multi-section removable protective pad onto the upper arm and/or shoulder.

In yet another alternative version of the multi-section removable protective pad not depicted, the multi-section removable protective pad, or a section or sections thereof, is/are secured onto 1) the upper arm by either one or two adjustable, elastic straps that encircle the upper arm, are inserted through a loop attached to the multi-section removable protective pad—although a slot or opening in the multi-section removable protective pad could be utilized—reverse back, and are fastened onto itself by a fastening device to secure the multi-section removable protective pad to the upper arm and 2) the shoulder by an adjustable, elastic strap that encircles the shoulder, is inserted through a loop attached to the multi-section removable protective pad—although a slot or opening in the multi-section removable protective pad could be utilized—reverses back, and is fastened onto itself by a fastening device to secure the multi-section removable protective pad to the shoulder.

In still yet another alternative version of the multi-section removable protective pad not depicted, the multi-section removable protective pad comprises two sections whereby the top section protects the shoulder/upper arm region of the user, or portions thereof, and the bottom section protects the upper arm region, or a portion thereof, of the user, the bottom section being contoured to overlap with any protective elbow pad worn by the user which is similar in design to the commercially available elbow pads utilized by skateboarders and inline skaters.

As illustrated in FIGS. 5 and 6, the first section 35, second section 45 and third section 55 of the multi-section removable protective pad 25 are secured together by adjustable, removable, elastic straps 65 that loop or pass through double slots or openings 75 on the first section 35 and the second section 45, and the second section 45 and the third section 55—although loops attached onto the respective sections could also be utilized—and are fastened onto themselves by a fastening device (hidden from view) to secure the sections of the multi-section removable protective pad 25 together. Excellent results are obtained when the fastening device comprises or is constructed of hook-and-loop fastening-type material.

As various possible embodiments may be made in the above invention for varying usages and for varying purposes, and as various changes might be made in the embodiments and methods above set forth, and as the details concerning certain common practices may not have been included, it is understood that all of the above matters here set forth or shown in the accompanying drawings are to be interpreted as illustrative and not in a limiting sense.

What is claimed is:

1. A removable protective pad and article of clothing combination for the purpose of protecting against impact to the top, anterior posterior and lateral regions of the shoulder and upper arm, the protective pad and article of clothing combination comprises:

an article of clothing selected from the group consisting of a protective body vest, a shirt, or an upper torso garment;

at least one protective pad, the protective pad comprising at least one layer of padding material, the layer of padding material having a rigid material attached thereon for protecting the underlying shoulder and upper arm from impact; and shoulder fastening means for attaching the protective pad around a shoulder portion of the article of clothing; and fastening means for attaching the pad to the upper arm portion of the body.

2. The removable protective pad and article of clothing combination of claim 1 wherein the rigid material comprises at least one section, the section being detachably attached to the protective pad.

3. The removable protective pad and article of clothing combination of claim 1 wherein the padding and rigid material comprises at least one ventilation hole therethrough.

4. The removable protective pad and article of clothing combination of claim 1 wherein the shoulder fastening means is defined by a first adjustable strap being passed through a first loop being generally adjacent to a upper end of the protective pad.

5. The removable protective pad and article of clothing combination of claim 4 wherein the first adjustable strap is removable.

6. The removable protective pad and article of clothing combination of claim 1 wherein the fastening means is defined by a second adjustable strap being wrapped around the upper arm portion and being generally adjacent to a lower end of the protective pad.

7. The removable protective pad and article of clothing combination of claim 6 wherein the second adjustable strap is removable.

8. The removable protective pad and article of clothing combination of claim 1 wherein the shoulder fastening means is attached to the protective pad and an exposed surface being on a removable strap, the removable adjustable strap comprising opposite ends, the removable adjustable strap being attached to the shoulder portion by being wrapped around the shoulder portion so as to enable the opposite ends to be fastened together.

9. The removable protective pad and article of clothing combination of claim 1 wherein the protective pad is attached to the shoulder portion by matable fastening means for attaching the protective pad correspondingly to an exposed surface of the shoulder portion.

* * * * *